US011525231B2

(12) United States Patent
Chen et al.

(10) Patent No.: US 11,525,231 B2
(45) Date of Patent: Dec. 13, 2022

(54) DOUBLE-SPIRAL-TUBE STRUCTURE, GROUTING AND PILE FORMING DEVICE AND CONSTRUCTION METHOD FOR STRENGTHENING SOFT SOIL

(71) Applicant: OCEAN UNIVERSITY OF CHINA, Qingdao (CN)

(72) Inventors: Xuguang Chen, Qingdao (CN); Guangkun Lu, Qingdao (CN); Ning Zhang, Qingdao (CN); Yong Wan, Qingdao (CN)

(73) Assignee: OCEAN UNIVERSITY OF CHINA, Qingdao (CN)

( * ) Notice: Subject to any disclaimer, the term of this patent is extended or adjusted under 35 U.S.C. 154(b) by 0 days.

(21) Appl. No.: 17/728,998

(22) Filed: Apr. 26, 2022

(65) Prior Publication Data

US 2022/0251794 A1 Aug. 11, 2022

Related U.S. Application Data

(63) Continuation of application No. PCT/CN2021/074927, filed on Feb. 2, 2021.

(30) Foreign Application Priority Data

Nov. 9, 2020 (CN) ..... 202011240479.8

(51) Int. Cl.
*E02D 5/46* (2006.01)
*E02D 3/12* (2006.01)

(52) U.S. Cl.
CPC ..... *E02D 5/46* (2013.01); *E02D 3/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,018,056 | A | 4/1977 | Poma | |
| 11,225,768 | B1 * | 1/2022 | Zhang | E02D 19/16 |
| 2022/0120052 | A1 * | 4/2022 | Zhang | E02D 5/80 |

FOREIGN PATENT DOCUMENTS

| | | | |
|---|---|---|---|
| CN | 102330424 | A | 1/2012 |
| CN | 102995622 | A | 3/2013 |
| CN | 104131555 | A | 11/2014 |

(Continued)

*Primary Examiner* — Kyle Armstrong
(74) *Attorney, Agent, or Firm* — Bayramoglu Law Offices LLC

(57) ABSTRACT

A grouting and pile forming device includes a compartment box and a double-spiral-tube structure. The double-spiral-tube structure includes an outer spiral tube and an inner spiral tube, which are nested and fixed together. A top part of the outer spiral tube and a top part of the inner spiral tube are hermetically connected. An inner space of the inner spiral tube forms a grouting cavity. A space between the outer spiral tube and the inner spiral tube forms a drainage and delivery cavity. A plurality of drainage and delivery holes are provided in a tube body of the outer spiral tube. A construction method for strengthening soft soil through the grouting and pile forming device includes the following steps: 1) operation preparation; 2) downward spiral penetration; 3) drainage consolidation; 4) chemical consolidation; 5) upward spiral lifting; and 6) repeated operation until all soil to be strengthened is treated.

19 Claims, 6 Drawing Sheets

(56) References Cited

FOREIGN PATENT DOCUMENTS

| | | | | | |
|---|---|---|---|---|---|
| CN | 204185844 | U | | 3/2015 | |
| CN | 106337413 | A | | 1/2017 | |
| CN | 107237311 | A | | 10/2017 | |
| CN | 107313421 | A | | 11/2017 | |
| CN | 108221910 | A | | 6/2018 | |
| CN | 108978630 | A | | 12/2018 | |
| CN | 109440727 | A | | 3/2019 | |
| CN | 109440759 | A | | 3/2019 | |
| CN | 109826189 | A | | 5/2019 | |
| CN | 209538117 | U | | 10/2019 | |
| CN | 210975794 | U | | 7/2020 | |
| CN | 111648347 | A | | 9/2020 | |
| DE | 19845132 | A1 | * | 4/2000 | ..... E02D 3/02 |
| EP | 1959057 | A2 | | 8/2008 | |
| JP | 2014152447 | A | | 8/2014 | |
| JP | 6664648 | B1 | | 3/2020 | |
| KR | 20150004360 | U | * | 5/2014 | |

* cited by examiner

DOUBLE-SPIRAL-TUBE STRUCTURE, GROUTING AND PILE FORMING DEVICE AND CONSTRUCTION METHOD FOR STRENGTHENING SOFT SOIL

CROSS REFERENCE TO THE RELATED APPLICATIONS

This application is the continuation application of International Application No. PCT/CN2021/074927, filed on Feb. 2, 2021, which is based upon and claims priority to Chinese Patent Application No. 202011240479.8, filed on Nov. 9, 2020, the entire contents of which are incorporated herein by reference.

TECHNICAL FIELD

The present invention relates to the field of soft foundation treatment, and more particularly, to a double-spiral-tube structure, a grouting and pile forming device and a construction method for strengthening soft soil.

BACKGROUND

Soft soil refers to silt, silty soil, partial hydraulic fill, miscellaneous fill, and other highly compressible soil. The foundation composed of soft soil is called soft soil foundation. Soft soil has special physical and mechanical properties, which leads to unique engineering properties. Soft soil has the features of high natural water content, large natural void ratio, low shear strength, high compressibility factor, and low permeability coefficient. Under the action of external loads, the soft soil foundation shows low bearing capacity, large deformation, large uneven deformation, and stable and long-lasting deformation.

Soft soil foundation treatment has always been a key and difficult point related to engineering safety. At present, soft soil treatment methods mainly include a composite treatment method, a dynamic compaction method, a drainage consolidation method, a high-pressure jet grouting method, a roller compaction method, etc. Among them, the drainage consolidation method aims to treat natural foundations. Sand drains, such as packed sand drains, plastic drains or other vertical drains are set up in the foundation, and then the foundation is gradually compressed by the weight of the building itself. Alternatively, the site is pre-compressed before the building is constructed. In this way, the pore water in the soil is discharged, the soil is gradually consolidated, and the foundation settles, thereby gradually increasing the strength. According to the different drainage measures, the drainage consolidation method is divided into a preloading method, a vacuum preloading method, a dewatering method, an electro-osmotic drainage method, etc. These foundation treatment methods can improve the strength and bearing performance of the soil, but they have problems such as difficult construction, complicated process, and limited application to land foundation treatment.

As China's resource consumption is increasing year by year, the development of rivers and ocean resources has become China's key development areas. The exploitation of resources is inseparable from the construction of basic projects. The scouring of ocean waves and currents will destroy the underwater soil foundation of the building structure, thereby decreasing in the overall strength and bearing capacity of the underwater soil. The underwater soil, especially the deep-sea soil, is in a saturated state with extremely high water content, and has a loosely arranged solid particle framework, which leads to low strength and low bearing capacity of the soil. When subjected to an external environmental load, the underwater soil is easily damaged, which will seriously affect the operation of the project. Therefore, it is necessary to strengthen the underwater soft soil. However, due to the special occurrence environment of underwater soil, especially seabed soil, the prior soft soil treatment methods cannot all be effectively applied to the strengthening of the underwater soft soil.

Chinese patent application 201821726384.5 discloses a vibroflotation grouting device for strengthening a seabed soil foundation. The device effectively combines vibroflotation and grouting methods to allow the cement slurry to be fully mixed with the collapsed soil under vibroflotation so as to form a composite foundation, which strengthens the loose soil around the pile foundation. However, this device fails to effectively use the drainage consolidation method to solve the shortcoming of large water content in the soft seabed soil.

Chinese patent application 201811241214.2 discloses a dewatering consolidation device and method for a seabed soil layer. This patent uses the drainage consolidation method to treat the seabed soil, which is suitable for the rapid consolidation of the seabed soil as well as the consolidation treatment of the land-based water-bearing foundations. However, it cannot be effectively combined with the grouting and pile forming method to strengthen the soil, and the treatment form is single.

Therefore, in the prior art, there is a lack of a simple, flexible, widely used and highly reliable device and method for strengthening soft soil.

SUMMARY

An objective of the present invention is to provide a double-spiral-tube structure, a grouting and pile forming device and a construction method for strengthening soft soil. The present invention can solve the problems of soft soil with low strength, low bearing capacity and large water content.

In order to solve the problems existing in the prior art, a first aspect of the present invention provides a double-spiral-tube structure for strengthening soft soil. The double-spiral-tube structure includes an outer spiral tube and an inner spiral tube, where the outer spiral tube and the inner spiral tube are nested and fixed together; a top part of the outer spiral tube and a top part of the inner spiral tube are hermetically connected; an inner space of the inner spiral tube forms a grouting cavity; a space between the outer spiral tube and the inner spiral tube forms a drainage and delivery cavity; and a plurality of drainage and delivery holes are provided in a tube body of the outer spiral tube.

Preferably, the inner spiral tube and the outer spiral tube may be thin-walled round tubes; and an inner diameter of the outer spiral tube may be greater than an inner diameter of the inner spiral tube, and a ratio of the inner diameter of the inner spiral tube to the inner diameter of the outer spiral tube may be 1:(1.2-1.8).

Preferably, each of the drainage and delivery holes may be provided with a filter screen to prevent clogging.

Preferably, the top part of the inner spiral tube and the top part of the outer spiral tube may be hermetically connected by a tapered round tube through welding to seal a gap between the top part of the inner spiral tube and the top part of the outer spiral tube; one end of the tapered round tube may be connected to the inner spiral tube and has a radius adapted to that of the inner spiral tube; the other end of the tapered round tube may be connected to the outer spiral tube and has a radius adapted to that of the outer spiral tube; and the tapered design may reduce the penetration resistance of the structure, and facilitate the penetration of the entire structure.

Preferably, the top part of the inner spiral tube may be provided with a grouting nozzle, and the grouting nozzle may have a size adapted to the inner diameter of the inner spiral tube.

Preferably, a grouting valve may be provided at a tail part of the inner spiral tube.

Preferably, a supporting structure may be provided between the inner spiral tube and the outer spiral tube to enhance the overall stability of the inner and outer spiral tubes.

Preferably, the supporting structure may be a supporting rod; one end of the supporting rod may be welded to an outer wall of the inner spiral tube, and the other end of the supporting rod may be welded to an inner wall of the outer spiral tube; and the design of the supporting rod may not affect the flow of pore water and a soft soil consolidation agent.

A second aspect of the present invention further provides a grouting and pile forming device with a double-spiral-tube structure. The grouting and pile forming device includes a compartment box, where the compartment box is fixedly connected to a tail part of the double-spiral-tube structure; the compartment box includes a storage compartment and a water pump compartment; the storage compartment is configured to store a soft soil consolidation agent; a water pump is provided inside the water pump compartment; the storage compartment and the water pump compartment are in communication with the drainage and delivery cavity; a storage compartment valve is provided between the storage compartment and the drainage and delivery cavity; and a pumping valve is provided between the water pump compartment and the drainage and delivery cavity.

Preferably, the double-spiral-tube structure may be integrally or separately connected to the compartment box at the tail part; the separate connection mode may be convenient for the replacement of double-spiral-tube structures of different specifications; and the separate connection mode may specifically use a connecting disc.

Preferably, the storage compartment, the water pump compartment and the drainage and delivery cavity may be connected through a tube.

A third aspect of the present invention further provides a construction method for strengthening soft soil through the grouting and pile forming device, which includes the following steps:

1) operation preparation: according to an actual situation of a project, the grouting and pile forming device with the double-spiral-tube structure of a certain length is selected, and the grouting and pile forming device is connected to an external driving device and then placed vertically at a suitable position above a soft soil layer to be strengthened, such that a top part of the double-spiral-tube structure is adjacent to the soft soil;

2) downward spiral penetration: the external driving device is started, such that the grouting and pile forming device entirely and spirally penetrates the soft soil layer in a vertical direction to a design depth;

3) drainage consolidation: the pumping valve is switched on, the grouting valve is switched off, and the water pump is started; the water pump operates to reduce a pressure in the drainage and delivery cavity; pore water in the soft soil layer passes through the filter screen under the action of a seepage force, enters the drainage and delivery cavity from the drainage and delivery holes, spirally flows upward along the drainage and delivery cavity, and is finally discharged from a top opening of the compartment box; and the drainage consolidation is maintained for a period of time until a drainage consolidation requirement is met;

4) chemical consolidation: after the drainage consolidation is completed, the storage compartment valve is switched on, and blades of the water pump are controlled to run reversely; the soft soil consolidation agent enters the drainage and delivery cavity through the storage compartment valve, and spirally flows downward along the drainage and delivery cavity; when the soft soil consolidation agent flows through all the drainage and delivery holes, the soft soil consolidation agent enters the soft soil layer through the filter screen, and reacts with the soft soil to chemically consolidate the soft soil, so as to strengthen the soft soil layer; and when the chemical consolidation is completed, the water pump, the pumping valve and the storage compartment valve are switched off;

5) upward spiral lifting: a grouting pump is connected to a tail part of the grouting cavity through a hose; the grouting valve is switched on to open the grouting nozzle, and the grouting pump is started; the grouting and pile forming device is entirely driven by the external driving device to be lifted spirally upward; in the upward lifting, cement slurry is driven by the grouting pump to be injected into voids of the soil from the grouting cavity through the grouting nozzle to fill a soil space formed in the downward penetration of the entire device; and an upward spiral lifting speed of the device is adapted to a jet grouting speed, such that the cement slurry fully fills the soil space; and 6) repeated operation: after a grouting process of the upward spiral lifting is finished, the grouting pump and the grouting nozzle are switched off; and the device is entirely moved to a next position, and the above steps are repeated until all the soil to be strengthened is treated.

Preferably, in step 3), if the filter screen is blocked by sand during the drainage consolidation such that the device fails to normally discharge the pore water in the soft soil layer, the water pump may be controlled to be reversed; and the liquid in the drainage and delivery cavity may be discharged through the drainage and delivery holes, and the liquid flowing in a reverse direction may flush the filter screen, so as to ensure a soil filtration and water penetration function of the filter screen.

The present invention has the following advantages:

1. The present invention adopts an ingenious structural design to effectively reduce the water content of soft soil through drainage consolidation, such that the soft soil is fully consolidated and the overall strength of the soil is improved.

2. The present invention solves the problem of the low strength and low bearing capacity of the soft soil foundation, and introduces the soft soil consolidation agent to produce a chemical reaction with the soft soil to further consolidate the soil and enhance the strength of the soft soil layer.

3. The present invention applies a spiral pile forming method to soft soil strengthening through grouting reinforcement. Compared with ordinary piles, the side area of the spiral pile is increased, which increases the side friction resistance and anti-pull performance of the pile, as well as the strength and bearing capacity of the foundation, thereby achieving a firm effect.

4. The present invention combines three strengthening methods, and can select devices of different lengths according to the depth of different soft soil layers to adapt to different depths of soft soil strengthening, and has strong adaptability.

5. The present invention has a wide range of applications, and is suitable for strengthening soft soil on land, underwater, and deep seas.

6. The device of the present invention is simple and easy to operate, reusable and flexible.

Figure 1:
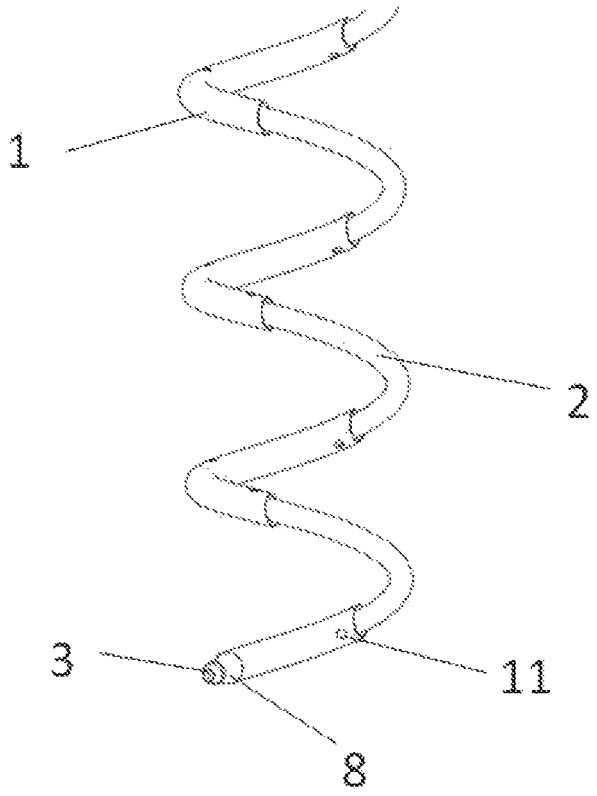
FIG. 1 is a partial structural view of a double-spiral-tube structure according to the present invention.
Figure 2:
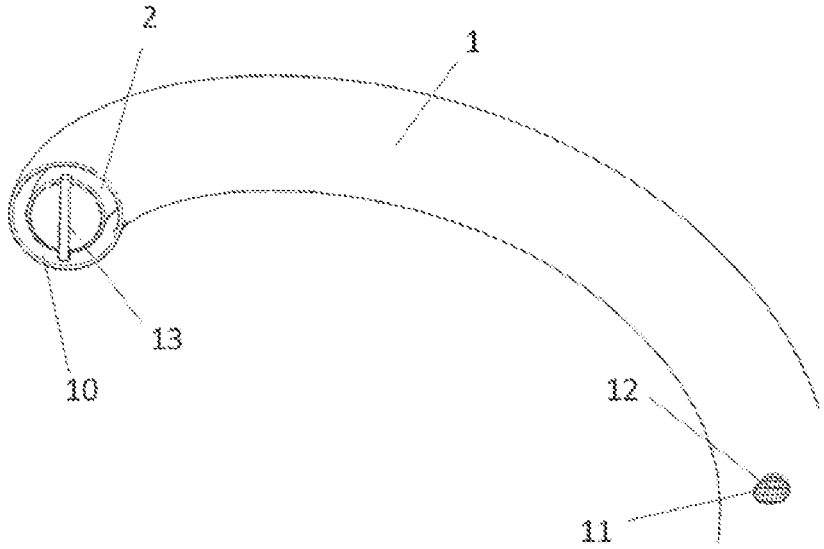
FIG. 2 is a structural view of tail parts of inner and outer spiral tubes of a spiral grouting and pile forming device for strengthening seabed soil according to the present invention.
Figure 3:
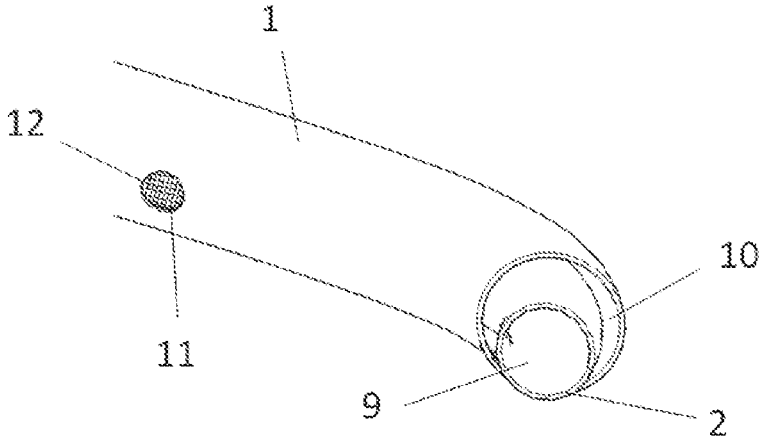
FIG. 3 is a structural view of top parts of the inner and outer spiral tubes of the spiral grouting and pile forming device for strengthening seabed soil according to the present invention.
Figure 4:
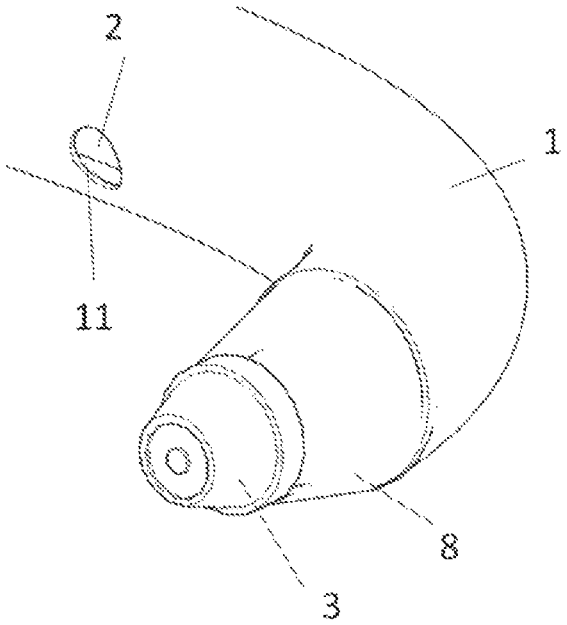
FIG. 4 is a structural view of a grouting nozzle of the inner and outer spiral tubes of the spiral grouting and pile forming device for strengthening seabed soil according to the present invention.

Reference Numerals: 1. outer spiral tube; 2. inner spiral tube; 3. grouting nozzle; 4. compartment box; 5. storage compartment; 6. water pump compartment; 7. connecting portion; 8. tapered round tube; 9. grouting cavity; 10. drainage and delivery cavity; 11. drainage and delivery hole; 12. filter screen; 13. grouting valve; 14. storage compartment valve; 15. pumping valve; 16. soft soil layer; 17. soft soil consolidation agent; 18. spiral cement pile; 19. water pump; and 20. external driving device.

DETAILED DESCRIPTION OF THE EMBODIMENTS

Preferred Embodiment 1

To facilitate a further understanding of the present invention, the present invention is described in detail below with reference to the preferred implementation schemes of the present invention.

Referring to FIGS. 1 to 4, a double-spiral-tube structure for strengthening soft soil includes an outer spiral tube 1 and an inner spiral tube 2. The outer spiral tube 1 and the inner spiral tube 2 are nested and fixed together. An overall length of the double-spiral-tube structure is adapted to a thickness of a soft seabed soil and a construction requirement, and a length of the inner spiral tube in a spiral direction is slightly greater than that of the outer spiral tube in the spiral direction. A top part of the outer spiral tube 1 and a top part of the inner spiral tube 2 are hermetically connected. An inner space of the inner spiral tube 2 forms a grouting cavity. A space between the outer spiral tube 1 and the inner spiral tube 2 forms a drainage and delivery cavity 10. A plurality of drainage and delivery holes 11 are provided in a tube body of the outer spiral tube 1. The inner spiral tube 2 and the outer spiral tube 1 are thin-walled round tubes. An inner diameter of the outer spiral tube is greater than an inner diameter of the inner spiral tube, and a ratio of the inner diameter of the inner spiral tube to the inner diameter of the outer spiral tube is 1:1.3. Each of the drainage and delivery holes 11 is provided with a filter screen 12 to prevent clogging. The top part of the inner spiral tube 2 and the top part of the outer spiral tube 1 are hermetically connected by a tapered round tube 8 through welding to seal a gap between the top part of the inner spiral tube 2 and the top part of the outer spiral tube 1. One end of the tapered round tube 8 is connected to the inner spiral tube 2 and has a radius adapted to that of the inner spiral tube 2. The other end of the tapered round tube is connected to the outer spiral tube 1 and has a radius adapted to that of the outer spiral tube 1. The tapered design reduces the penetration resistance of the structure, and facilitates the penetration of the entire structure. The top part of the inner spiral tube 2 is provided with a grouting nozzle 3, and the grouting nozzle 3 has a size adapted to the inner diameter of the inner spiral tube 2. A grouting valve 13 is provided at a tail part of the inner spiral tube 2. The cement grouting cavity and the drainage and delivery cavity are separated by the inner spiral tube, and the cement grouting cavity and the drainage and delivery cavity work independently and without interfering with each other. A supporting structure is provided between the inner spiral tube 2 and the outer spiral tube 1 to enhance the overall stability of the inner and outer spiral tubes. The supporting structure is a supporting rod. One end of the supporting rod is welded to an outer wall of the inner spiral tube, and the other end of the supporting rod is welded to an inner wall of the outer spiral tube. The design of the supporting rod does not affect the flow of pore water and a soft soil consolidation agent.

Figure 5:
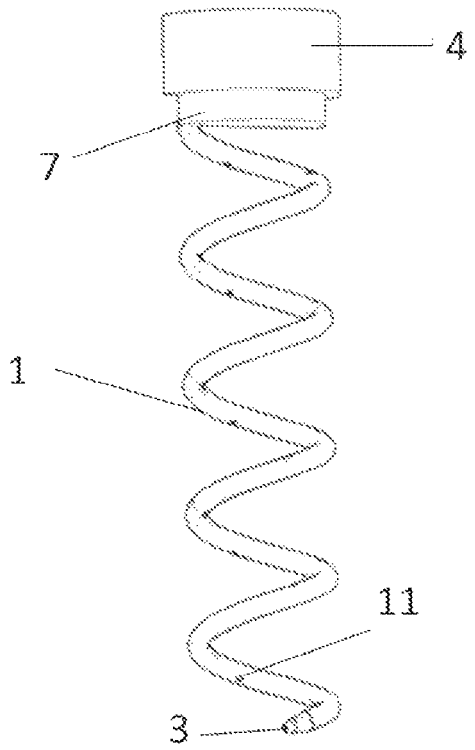
FIG. 5 is a full structural view of the spiral grouting and pile forming device for strengthening seabed soil according to the present invention.
Figure 6:
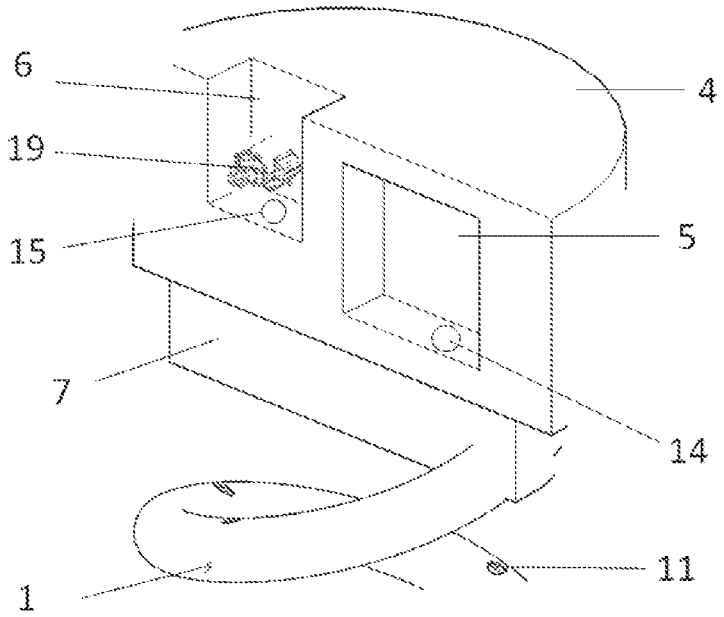
FIG. 6 is a lateral view of a compartment box and a driving device box of the spiral grouting and pile forming device for strengthening seabed soil according to the present invention.
Figure 7:
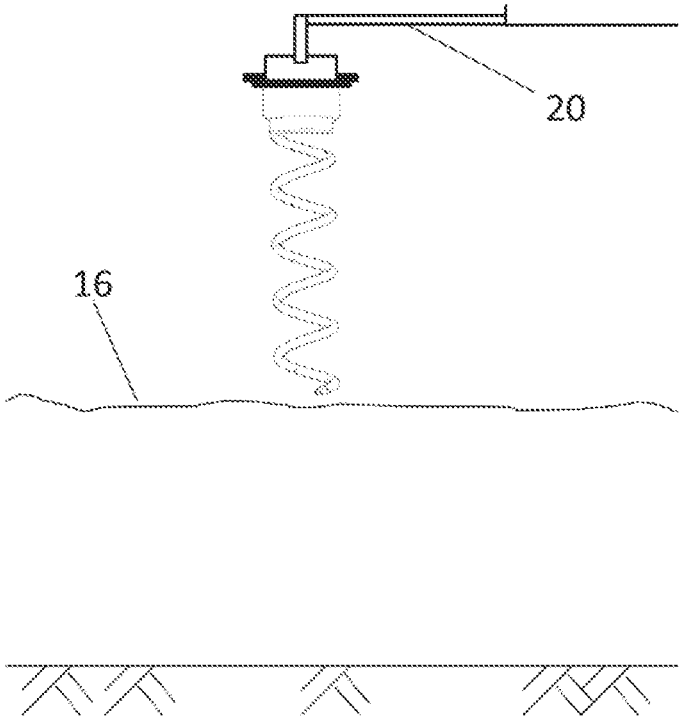
FIG. 7 is a schematic view of an operation preparation step of a spiral grouting and pile forming method for strengthening seabed soil according to the present invention.
Figure 8:
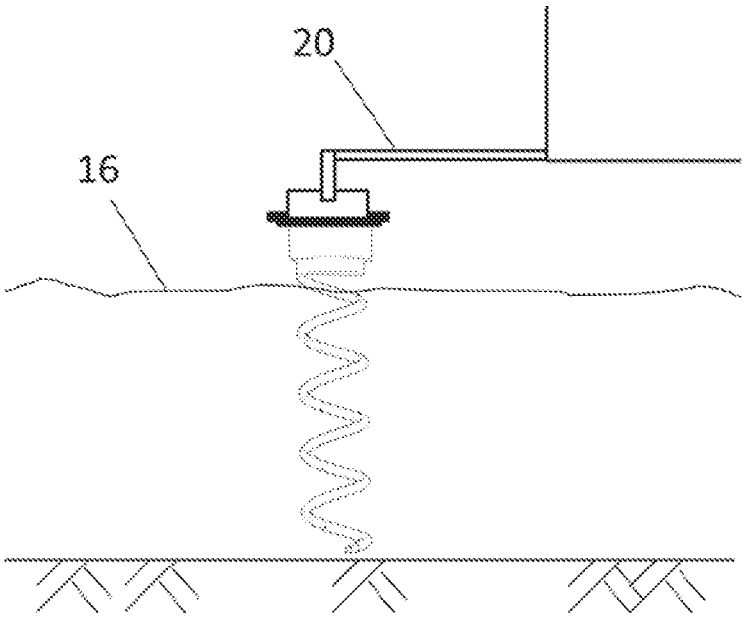
FIG. 8 is a schematic view of a downward spiral penetration step of the spiral grouting and pile forming method for strengthening seabed soil according to the present invention.
Figure 9:
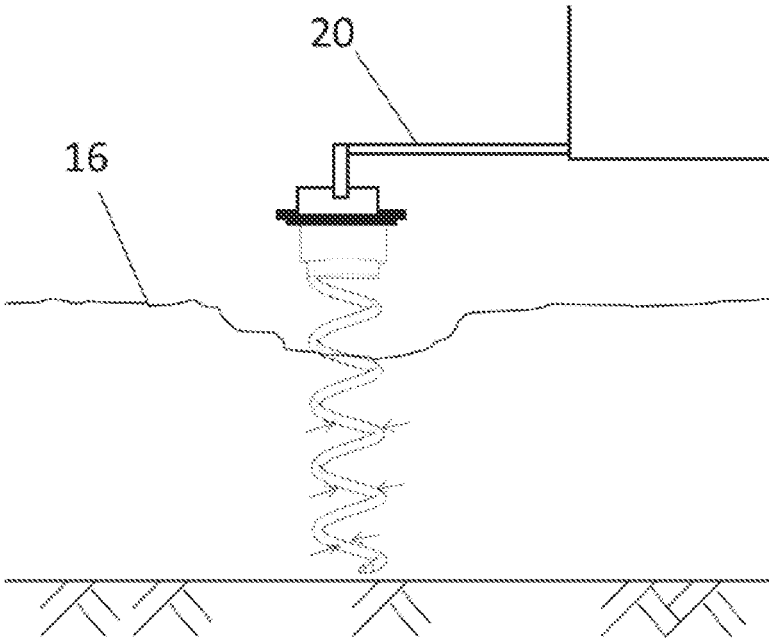
FIG. 9 is a schematic view of a drainage consolidation step of the spiral grouting and pile forming method for strengthening seabed soil according to the present invention.
Figure 10:
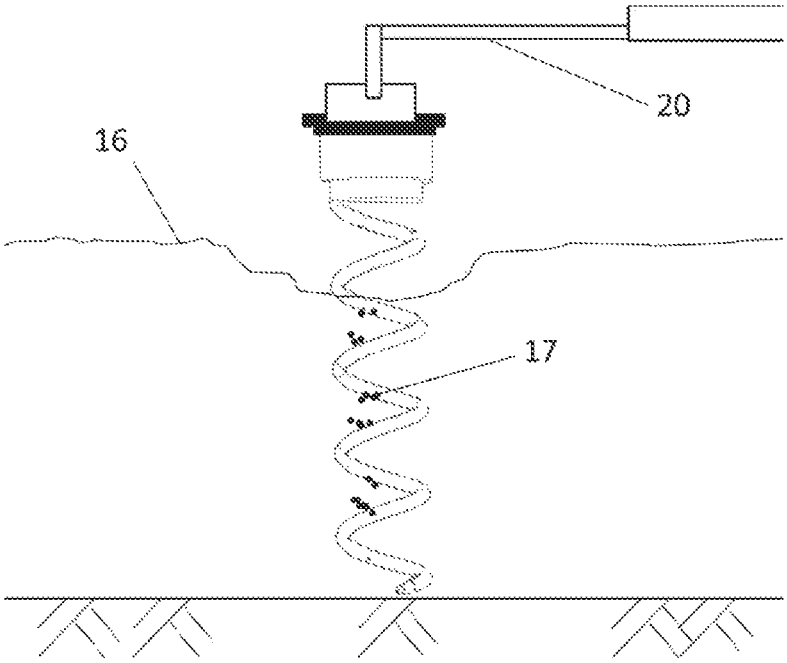
FIG. 10 is a schematic view of a chemical consolidation step of the spiral grouting and pile forming method for strengthening seabed soil according to the present invention.
Figure 11:
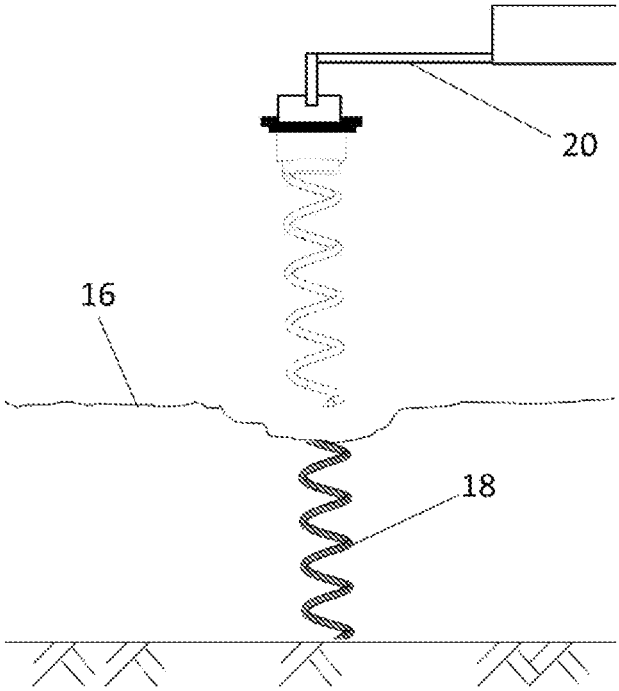
FIG. 11 is a schematic view of an upward spiral lifting step of the spiral grouting and pile forming method for strengthening seabed soil according to the present invention.

Referring to FIGS. 5 and 6, the present invention further provides a grouting and pile forming device with the double-spiral-tube structure. The grouting and pile forming device includes a compartment box 4. The compartment box 4 is fixedly connected to a tail part of the double-spiral-tube structure. The compartment box includes a storage compartment 5 and a water pump compartment 6. The storage compartment 5 is a sealed space for storing a soft soil consolidation agent 17 for strengthening soft soil. Specifically, according to different types of soft soil, commonly used consolidation agents conducive to the consolidation of soft soil may be selected. In the present invention, the consolidation agent is liquid, or a solid consolidation agent is dissolved in a solution for use. The water pump compartment 6 is an open compartment, and a water pump 19 is provided inside the water pump compartment 6. The water pump is a high-pressure pump. The storage compartment 5 and the water pump compartment 6 are in communication with the drainage and delivery cavity 10. A storage compartment valve 14 is provided between the storage compartment 5 and the drainage and delivery cavity 10. A pumping valve 15 is provided between the water pump compartment 6 and the drainage and delivery cavity 10. The double-spiral-tube structure is separately connected to the compartment box at the tail part. A connecting portion 7 is provided between the double-spiral-tube structure and the compartment box, and the connecting portion 7 may be a connecting disc. The separate connection mode is convenient for the replacement of double-spiral-tube structures of different specifications. The storage compartment 5, the water pump compartment 6 and the drainage and delivery cavity 10 are connected through a tube.

Referring to FIGS. 7 to 11, the present invention further provides a construction method for strengthening soft soil through the grouting and pile forming device, which includes the following steps:

1) Operation preparation: According to an actual situation of a project, the grouting and pile forming device with the double-spiral-tube structure of a certain length is selected, and the grouting and pile forming device is connected to an external driving device 20 and then placed vertically at a suitable position above a soft soil layer 16 to be strengthened, such that a top part of the double-spiral-tube structure is adjacent to the soft soil.

2) Downward spiral penetration. The external driving device 20 is started, such that the grouting and pile forming device entirely and spirally penetrates the soft soil layer in a vertical direction to a design depth.

3) Drainage consolidation: The pumping valve 15 is switched on, the grouting valve 13 is switched off, and the water pump 19 is started. The water pump 19 operates to reduce a pressure in the drainage and delivery cavity 10. Pore water in the soft soil layer passes through the filter screen under the action of a seepage force, enters the drainage and delivery cavity 10 from the drainage and delivery holes 11, spirally flows upward along the drainage and delivery cavity 10, and is finally discharged from a top opening of the compartment box 4. The drainage consolidation is maintained for a period of time until a drainage consolidation requirement is met.

4) Chemical consolidation: After the drainage consolidation is completed, the storage compartment valve 14 is switched on, and blades of the water pump are controlled to run reversely. The soft soil consolidation agent 17 enters the drainage and delivery cavity through the storage compartment valve 14, and spirally flows downward along the drainage and delivery cavity. When the soft soil consolidation agent 17 flows through all the drainage and delivery holes 11, the soft soil consolidation agent enters the soft soil layer through the filter screen 12, and reacts with the soft soil to chemically consolidate the soft soil, so as to strengthen the soft soil layer. When the chemical consolidation is completed, the water pump, the pumping valve and the storage compartment valve are switched off.

5) upward spiral lifting: A grouting pump is connected to a tail part of the grouting cavity 9 through a hose. The grouting valve 13 is switched on to open the grouting nozzle, and the grouting pump is started. The grouting and pile forming device is entirely driven by the external driving device 20 to be lifted spirally upward. In the upward lifting, cement slurry is driven by the grouting pump to be injected into voids of the soil from the grouting cavity 9 through the grouting nozzle 3 to fill a soil space formed in the downward penetration of the entire device. An upward spiral lifting speed of the device is adapted to a jet grouting speed, such that the cement slurry fully fills the soil space.

6) Repeated operation: After a grouting process of the upward spiral lifting is finished, the grouting pump and grouting nozzle 3 are switched off. A complete spiral cement pile 18 is formed in the soft soil, which further improves the bearing capacity of the soft seabed soil. The device is entirely moved to a next position, and the above steps are repeated until all the soil to be strengthened is treated.

Preferably, in step 3), if the filter screen 12 is blocked by sand during the drainage consolidation such that the device fails to normally discharge the pore water in the soft soil layer, the water pump is controlled to be reversed. Thus, the liquid in the drainage and delivery cavity 10 is discharged through the drainage and delivery holes 11, and the liquid flowing in a reverse direction flushes the filter screen 12, so as to ensure a soil filtration and water penetration function of the filter screen 12.

Preferred Embodiment 2

The basic technical solution of this embodiment is the same as that of Preferred Embodiment 1, except that the inner diameter ratio of the inner and outer spiral tubes is 1:1.7, and in order to ensure the integrity of the device, the double-spiral-tube structure and the compartment box are integrally welded through a connecting portion.

Although the present invention is described with reference to the preferred embodiments, the protection scope of the present invention is not limited there-to. Without departing from the scope of the present invention, various improvements can be made to the present invention and the components therein can be replaced with equivalents. The various technical features mentioned in the various embodiments can be combined in any manner in case of no structural conflict. Any reference numerals in the claims should not be regarded as limiting the involved claims, and the embodiments should be regarded as exemplary and non-restrictive from any point of view. Therefore, any technical solution falling within the scope of the claims is within the protection scope of the present invention.

What is claimed:

1. A grouting and pile forming device for strengthening soft soil, comprising a compartment box and a double-spiral-tube structure, wherein the double-spiral-tube structure comprises an outer spiral tube and an inner spiral tube, wherein the outer spiral tube and the inner spiral tube are nested and fixed together;

a top part of the outer spiral tube and a top part of the inner spiral tube are hermetically connected;

an inner space of the inner spiral tube forms a grouting cavity;

a space between the outer spiral tube and the inner spiral tube forms a drainage and delivery cavity;

a plurality of drainage and delivery holes are provided in a tube body of the outer spiral tube;

the compartment box is fixedly connected to a tail part of the double-spiral-tube structure;

the compartment box comprises a storage compartment and a water pump compartment;

the storage compartment is configured to store a soft soil consolidation agent;

a water pump is provided inside the water pump compartment;

the storage compartment and the water pump compartment are in communication with the drainage and delivery cavity;

a storage compartment valve is provided between the storage compartment and the drainage and delivery cavity; and a pumping valve is provided between the water pump compartment and the drainage and delivery cavity.

2. The grouting and pile forming device according to claim 1, wherein the inner spiral tube and the outer spiral tube are thin-walled round tubes; and an inner diameter of the outer spiral tube is greater than an inner diameter of the inner spiral tube, and a ratio of the inner diameter of the inner spiral tube to the inner diameter of the outer spiral tube is 1:(1.2-1.8).

3. The grouting and pile forming device according to claim 2, wherein each of the plurality of drainage and delivery holes is provided with a filter screen.

4. The grouting and pile forming device according to claim 2, wherein the top part of the inner spiral tube and the top part of the outer spiral tube are hermetically connected by a tapered round tube through welding.

5. The grouting and pile forming device according to claim 2, wherein the top part of the inner spiral tube is provided with a grouting nozzle, and a tail part of the inner spiral tube is provided with a grouting valve.

6. The grouting and pile forming device according to claim 2, wherein a supporting structure is provided between the inner spiral tube and the outer spiral tube; and the supporting structure is a supporting rod, wherein a first end of the supporting rod is welded to an outer wall of the inner spiral tube, and a second end of the supporting rod is welded to an inner wall of the outer spiral tube.

7. The grouting and pile forming device according to claim 1, wherein each of the plurality of drainage and delivery holes is provided with a filter screen.

8. The grouting and pile forming device according to claim 1, wherein the top part of the inner spiral tube and the top part of the outer spiral tube are hermetically connected by a tapered round tube through welding.

9. The grouting and pile forming device according to claim 1, wherein the top part of the inner spiral tube is provided with a grouting nozzle, and a tail part of the inner spiral tube is provided with a grouting valve.

10. The grouting and pile forming device according to claim 1, wherein a supporting structure is provided between the inner spiral tube and the outer spiral tube; and the supporting structure is a supporting rod, wherein a first end of the supporting rod is welded to an outer wall of the inner spiral tube, and a second end of the supporting rod is welded to an inner wall of the outer spiral tube.

11. The grouting and pile forming device according to claim 1, wherein the double-spiral-tube structure is integrally or separately connected to the compartment box at the tail part.

12. A construction method for strengthening the soft soil through the grouting and pile forming device according to claim 1, comprising the following steps:

1) performing operation preparation, wherein according to an actual situation of a project, the grouting and pile forming device with the double-spiral-tube structure of a certain length is selected, and the grouting and pile forming device is connected to an external driving device and then placed vertically at a suitable position above a soft soil layer to be strengthened, wherein a top part of the double-spiral-tube structure is adjacent to the soft soil;

2) performing downward spiral penetration, wherein the external driving device is started, and the grouting and pile forming device entirely and spirally penetrates the soft soil layer in a vertical direction to a design depth;

3) performing drainage consolidation, wherein the pumping valve is switched on, the grouting valve is switched off, and the water pump is started; the water pump operates to reduce a pressure in the drainage and delivery cavity; pore water in the soft soil layer passes through the filter screen under an action of a seepage force, enters the drainage and delivery cavity from the plurality of drainage and delivery holes, spirally flows upward along the drainage and delivery cavity, and is finally discharged from a top opening of the compartment box; and the drainage consolidation is maintained for a period of time until a drainage consolidation requirement is met;

4) performing chemical consolidation, wherein after the drainage consolidation is completed, the storage compartment valve is switched on, and blades of the water pump are controlled to run reversely; the soft soil consolidation agent enters the drainage and delivery cavity through the storage compartment valve, and spirally flows downward along the drainage and delivery cavity; when the soft soil consolidation agent flows through the plurality of drainage and delivery holes, the soft soil consolidation agent enters the soft soil layer through the filter screen, and reacts with the soft soil to chemically consolidate the soft soil, wherein the soft soil layer is strengthened; and when the chemical consolidation is completed, the water pump, the pumping valve and the storage compartment valve are switched off;

5) performing upward spiral lifting, wherein a grouting pump is connected to a tail part of the grouting cavity through a hose; the grouting valve is switched on to open the grouting nozzle, and the grouting pump is started; the grouting and pile forming device is entirely driven by the external driving device to be lifted spirally upward; in the upward spiral lifting, cement slurry is driven by the grouting pump to be injected into voids of the soil from the grouting cavity through the grouting nozzle to fill a soil space formed in the downward spiral penetration of the grouting and pile forming device; and an upward spiral lifting speed of the grouting and pile forming device is adapted to a jet grouting speed, wherein the cement slurry fully fills the soil space; and 6) performing repeated operation, wherein after a grouting process of the upward spiral lifting is finished, the grouting pump and the grouting nozzle are switched off; and the grouting and pile forming device is entirely moved to a next position, and the above steps are repeated until all the soil to be strengthened is treated.

13. The construction method according to claim 12, wherein in step 3), when the filter screen is blocked by sand during the drainage consolidation and the grouting and pile forming device fails to normally discharge the pore water in the soft soil layer, the water pump is controlled to be reversed; and liquid in the drainage and delivery cavity is discharged through the plurality of drainage and delivery holes, and the liquid flowing in a reverse direction flushes the filter screen, wherein a soil filtration and water penetration function of the filter screen is ensured.

14. The construction method according to claim 12, wherein the inner spiral tube and the outer spiral tube are thin-walled round tubes; and an inner diameter of the outer spiral tube is greater than an inner diameter of the inner spiral tube, and a ratio of the inner diameter of the inner spiral tube to the inner diameter of the outer spiral tube is 1:(1.2-1.8).

15. The construction method according to claim 12, wherein each of the plurality of drainage and delivery holes is provided with a filter screen.

16. The construction method according to claim 12, wherein the top part of the inner spiral tube and the top part of the outer spiral tube are hermetically connected by a tapered round tube through welding.

17. The construction method according to claim 12, wherein the top part of the inner spiral tube is provided with a grouting nozzle, and a tail part of the inner spiral tube is provided with a grouting valve.

18. The construction method according to claim 8, wherein a supporting structure is provided between the inner spiral tube and the outer spiral tube; and the supporting structure is a supporting rod, wherein a first end of the supporting rod is welded to an outer wall of the inner spiral tube, and a second end of the supporting rod is welded to an inner wall of the outer spiral tube.

19. The construction method according to claim 12, wherein the double-spiral-tube structure is integrally or separately connected to the compartment box at the tail part.

* * * * *